US005433009A

United States Patent [19]

Keels, Jr.

[11] Patent Number: 5,433,009

[45] Date of Patent: Jul. 18, 1995

[54] ROUTER TEMPLATE

[76] Inventor: Charles F. Keels, Jr., 421 N. L St., Lake Worth, Fla. 33460

[21] Appl. No.: 350,041

[22] Filed: May 27, 1994

[51] Int. Cl.[6] ..... B27G 17/08

[52] U.S. Cl. ..... 33/197; 33/562; 144/144.5 R

[58] Field of Search ..... 33/197, 194, 562; 144/27, 144.5 R, 144.5 GT, 371, 372

[56] References Cited

U.S. PATENT DOCUMENTS

| | | | |
|---|---|---|---|
| 1,718,324 | 6/1929 | Wappat | 144/70 |
| 2,355,603 | 8/1944 | Zern | 33/197 |
| 2,801,655 | 8/1957 | Zern | 33/197 |
| 2,854,761 | 10/1958 | Graham | 33/197 |
| 3,082,800 | 3/1963 | Soss | 33/197 |
| 3,211,026 | 10/1965 | Calahan | 33/197 |
| 3,221,784 | 12/1965 | Skollerud | 33/197 |
| 3,344,827 | 10/1967 | Kvalheim et al. | 144/27 |
| 3,442,308 | 5/1969 | Steffens | 144/27 |
| 3,789,892 | 2/1974 | Converse et al. | 33/197 |
| 4,299,263 | 11/1981 | Skinner | 144/144.5 R |
| 4,553,336 | 11/1985 | Ponce | 33/197 |
| 5,029,394 | 7/1991 | Carey | 33/194 |
| 5,042,543 | 8/1991 | Carey | 144/144.59 |
| 5,146,965 | 9/1992 | Gibson | 144/372 |

*Primary Examiner*—Thomas B. Will
*Attorney, Agent, or Firm*—McHale & Slavin

[57] ABSTRACT

The present invention is an adjustable router template suitable for use in forming a stepped recess in a door with the cutting tool of a router. The adjustable template includes a first or lower plate having a lower template opening providing the cutting tool with access to the surface of the door to be cut and a second or upper plate having at least one upper template opening through which the cutting tool is initially inserted to reach the lower opening. The upper opening is more restrictive than the lower opening in limiting the surface area of the door that can be cut by the router. The recess can be cut with a step by adjusting the distance between the first and second plates and adjusting the longitudinal orientation of the upper opening relative to the lower opening.

11 Claims, 3 Drawing Sheets

ROUTER TEMPLATE

FIELD OF THE INVENTION

The present invention is related to templates for cutting recesses into a door with a router, more particularly, to such a router template for cutting stepped recesses into the edge of a door, and even more particularly, to an adjustable router template for installing a flush bolt in a door.

BACKGROUND OF THE INVENTION

Double doors are often used to close-off doorways and other openings that are too large for a single door. To securely lock double doors in their closed position, at least one of the doors must be anchored to the door frame. Various locking systems have been employed to securely lock double doors in their closed position. These systems typically include a bolt mounted to each door with each bolt being slidable into an anchoring hole formed in the door frame header or in the floor. With some of these systems, the bolts are mounted onto the face of each door. However, having the bolts exposed in this manner is often considered unsightly and not as secure as other systems. A more preferred type of bolt locking system includes a bolt and an actuating mechanism that are sunk into one or both doors along their respective free swinging side edge. This type of system locks the doors more securely because the bolt assembly is actually embedded in the door, making it inaccessible and stronger. In addition, with these so called flush bolt systems, when the doors are closed, the locking system is not visible and therefore do not detract from the natural beauty of the doors. Thus, such flush bolt locking systems are particularly popular with double French-type doors, which are chosen for their aesthetic features.

Such flush bolt systems are typically installed by using a hand chisel or router to cut a stepped recess into the side edge of each door of a sufficient depth to accommodate the bolt actuating mechanism of the locking system. The side recess is formed with a shallow step to accommodate a relatively thin (e.g., ⅛ inch thick) face plate used to cover the actuating mechanism. A deeper step is also cut to accommodate the actuating mechanism itself. A bore hole through which the bolt slides is drilled vertically down from the top edge of the door adjacent to its free swinging side edge and into the deeper stepped portion of the side recess. Another shallow recess is then formed around the top opening of the bolt hole to receive a relatively thin (e.g., ⅛ inch thick) guide plate having a hole for the locking bolt to pass through. In the past, such recesses have been formed by hand with a chisel or by using a router. In general, compared to using a router, hand chiseling is time consuming and more often results in recesses that are inconsistent in size from one door to the next. With flush bolt locking systems the dimensions of the recesses can be critical. However, when used to cut a stepped recess such as that for a flush bolt locking system, routers have still proven to be more time consuming and inconsistent than desirable.

Therefore, there is a need for a way to quickly form such stepped recesses, while consistently maintaining the accuracy of the recess dimensions from door to door.

SUMMARY OF THE INVENTION

An objective of the present invention is to provide a way to quickly cut a stepped recess out of the edge of a door.

Another objective of the present invention is to provide a way to consistently maintain the accuracy of such a stepped recess from door to door.

An additional objective of the present invention is to provide a single template for cutting such stepped recesses with a router.

A further objective of the present invention is to provide an adjustable router template for cutting a stepped recess in a door suitable for receiving the bolt actuating mechanism of a flush bolt locking system.

These and other objectives of the present invention are obtained by providing an adjustable router template suitable for use in forming a stepped recess in a door with the cutting tool of a router. The adjustable template includes a first or lower plate having a lower template opening providing the cutting tool with access to the surface of the door to be cut and a second or upper plate having at least one upper template opening through which the cutting tool is initially inserted to reach the lower opening. The upper opening is more restrictive than the lower opening in limiting the surface area of the door that can be cut by the router. The recess can be cut with a step by providing a mechanism for adjusting the distance between the first and second plates and adjusting the longitudinal orientation of the upper opening relative to the lower opening.

One embodiment of the present adjustable template is particularly useful in router cutting a stepped recess in the free swinging side edge of a door. This template includes a first or lower channel bracket having a bottom formed by the first or lower plate and two opposite first side walls running along its length, and an inverted second or upper channel bracket having a top formed by the second or upper plate and two opposite second side walls running along its length. The second channel bracket is disposed with each of its side walls overlapping one corresponding first side wall in a juxtaposed relation, each of the side walls of either the upper or lower channel bracket has two longitudinally spaced adjusting slots formed therethrough. A plurality of guide pins are used to connect the two brackets together. Each guide pin has a first end and a second end. The first end is fixed to one channel bracket and the second end is disposed through one adjusting slot formed in the other channel bracket. The distance between the plates and the longitudinal orientation of the upper template opening relative to the lower template opening is controlled by the positioning of each guide pin in its respective adjusting slot.

In one feature of the above embodiment, each of the adjusting slots has at least two and preferably three retaining notches. Each of the retaining notches receives one of the guide pins such that with each guide pin seated in a corresponding retaining notch, the relative position of the brackets remains substantially stable while the cutting tool cuts a recessed area out of the door. In order to control the relative positions of the template openings, the three retaining notches in each slot are formed at three longitudinally spaced locations along the length of the respective side wall. In addition, two of the notches are spaced the same distance from and one spaced a shorter distance from their corresponding plate.

In operation, the first plate is secured to the edge of the door by conventional means, such as temporary nails driven into the door through holes formed in the first plate. The lower template opening is positioned over the area where the stepped recess is to be formed. With the second plate adjusted to a desired distance from the first plate, a recess having a uniform depth can be formed in the door by inserting the router cutting tool through the second and lower template openings and into the door until the router rests on the second plate. The surface area cut by the router is limited by the geometry of the upper opening. By both reducing the distance between the plates and shifting the longitudinal orientation of the upper opening relative to the lower opening, a deeper cut can be made in the door in an area that overlaps the initial area cut, thereby forming a stepped recess.

A number of stepped recesses can thus be quickly and consistently formed with a high degree of accuracy by so adjusting the distance between the plates and the relative orientation of the openings according to the principles of the present invention. The shape of each recess step formed can also be varied by changing the shape of the upper opening.

The above and other objectives, features, and advantages of the present invention will become apparent upon consideration of the detailed description and the appended drawings.

DETAILED DESCRIPTION OF THE INVENTION

Although the present invention is herein described in terms of a specific embodiment, it will be readily apparent to those skilled in this art that various modifications, rearrangement, and substitutions can be made without departing from the spirit of the invention. The scope of the present invention is thus only limited by the claims appended hereto.

Figure 1:
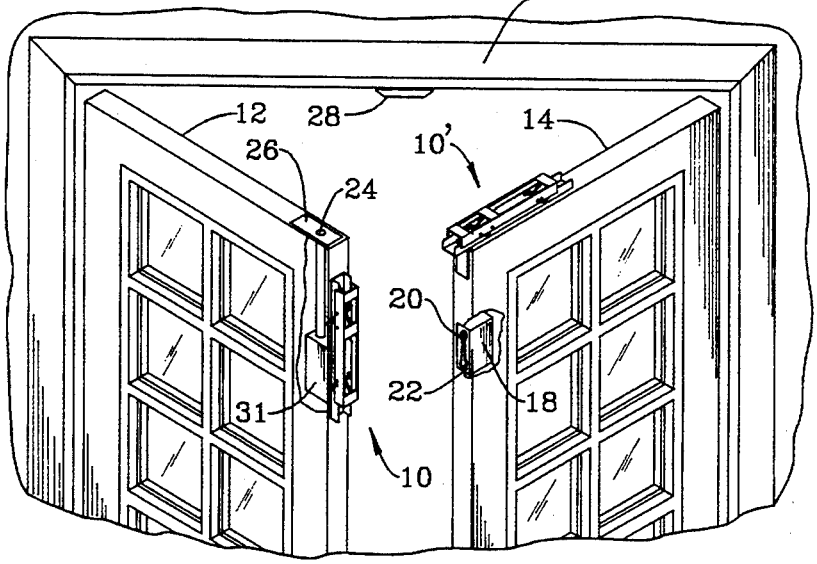
FIG. 1 is a perspective view of a pair of french doors with an embodiment of the present adjustable template in position on each door to form the recesses for a flush bolt locking system.

Referring to FIG. 1, two adjustable templates 10 and 10', according to one embodiment of the present invention, are each in position on one of two respective French doors 12 and 14 for forming the recesses necessary to install a flush bolt locking assembly in each door 12 and 14. The locking assembly includes a bolt actuating mechanism 18 having an actuating lever 20 and covered by a face plate 22 and including a vertical locking bolt 24 and bolt guide plate 26. A fixed template 28 is position under the door frame header 30 for forming the single step recess for a bolt anchor plate (not shown) into which the leading end of each bolt 24 may be inserted in order to lock the doors 12 and 14 closed. The template 10' is shown in position to form the recess for the bolt guide plate 26, and template 10 is shown in position to form a stepped recess 31 for the bolt actuating mechanism 18 and face plate 22.

Figure 2:
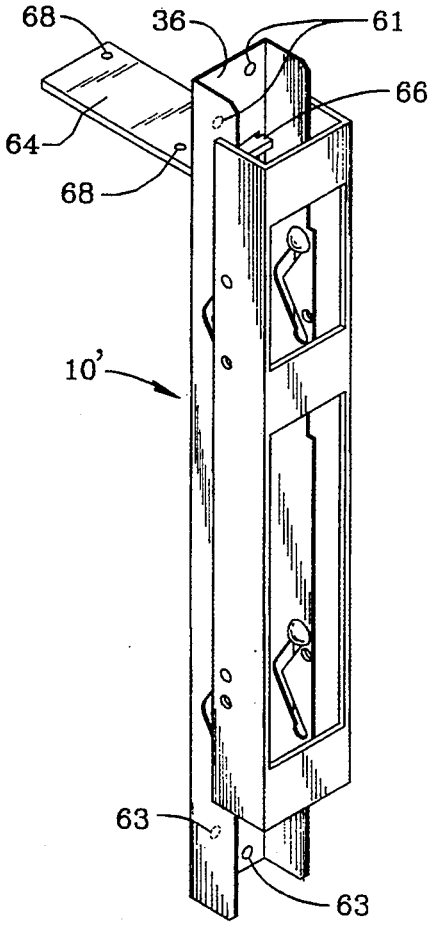
FIG. 2 is a perspective view of one of the adjustable templates of FIG. 1.
Figure 4:
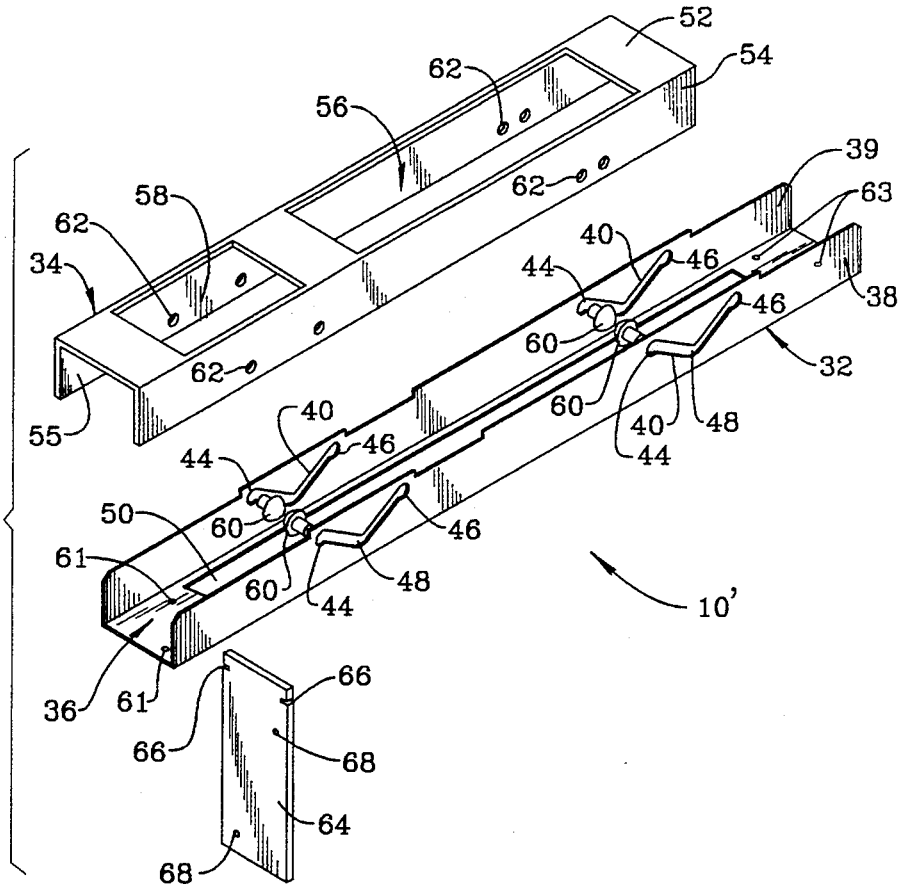
FIG. 4 is an exploded perspective view of the adjustable template of FIG. 2.

Referring to FIGS. 2 and 4, each adjustable template 10 and 10' includes a first or lower channel bracket 32 and a second or upper inverted channel bracket 34. The lower channel bracket 32 has a bottom formed by a first or lower plate 36 and opposite first side walls 38 and 39 running along its length. Each of the side walls 38 and 39 has two longitudinally spaced generally V-shaped adjusting slots 40 formed therethrough. Each of the adjusting slots 40 has a front and rear upper retaining notch 44 and 46 and a lower retaining notch 48 formed by the lowest point of its V-shape. The two upper notches 44 and 46 are positioned the same distance from the lower plate 36. The lower plate 36 has an inner edge forming a first or lower template opening 50 formed therethrough providing the cutting tool of a router (not shown) with access to the surface of whichever door 12, 14 is being worked on.

Figure 5:
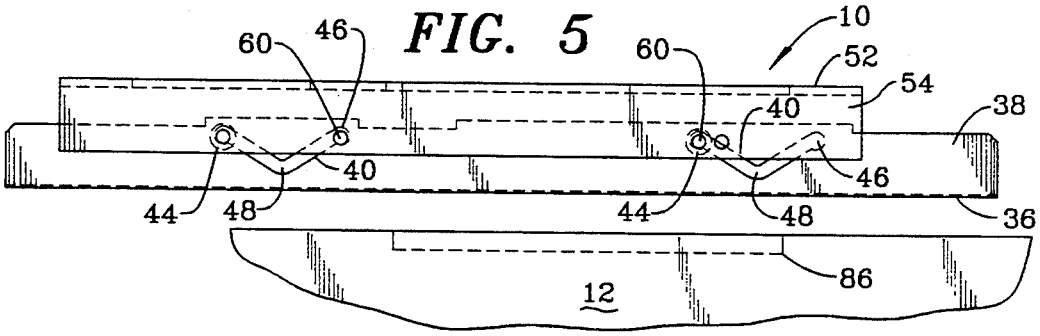
FIG. 5 is a side view of the adjustable template of FIG. 2, without its stop plate and with its plates set for maximum separation and its upper plate positioned fully forward.
Figure 6:
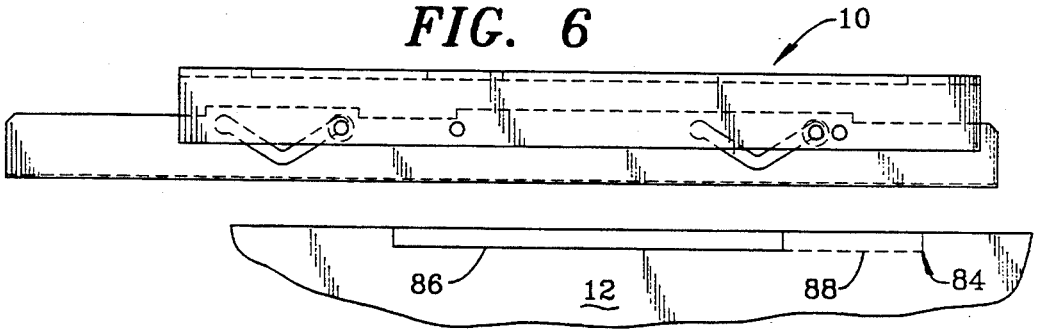
FIG. 6 is a side view of the adjustable template of FIG. 5 with its plates set for maximum separation and its upper plate fully rearward.
Figure 7:
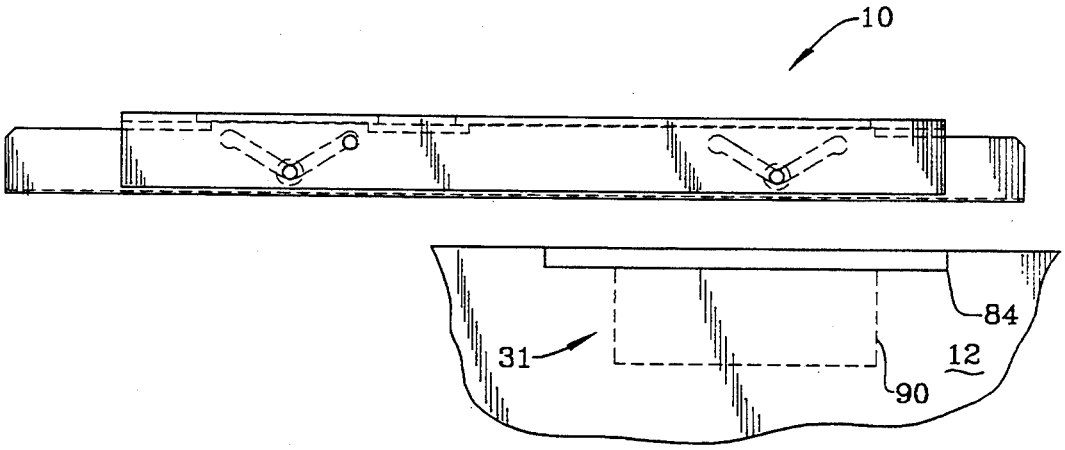
FIG. 7 is a side view of the adjustable template of FIG. 6 with its plates set for minimum separation and the upper plate at a middle longitudinal position.
Figure 8:
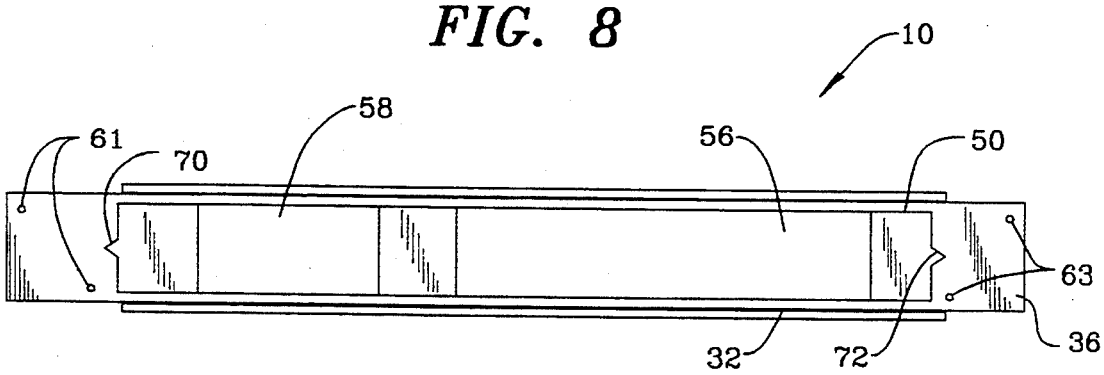
FIG. 8 is a bottom view of the template of FIG. 7.

The upper inverted channel bracket 34 has a top formed by a second or upper plate 52 with two opposite side walls 54 and 55 extending down therefrom and running along its length. The upper plate 52 has one inner edge forming a first upper template opening 56 and preferably another inner edge forming a second upper template opening 58 formed therethrough. Opening 58 is located near the front and opening 56 is located near the rear end of channel bracket 34. Each of said upper template openings 56 and 58 providing a path to the lower template opening 50 and thus the surface of door 14 for the cutting tool of a router (not shown). Each of the upper template openings 56 and 58 has a rectangular shaped perimeter that combined are smaller in area than the lower template opening 50, which also has a rectangular perimeter. Both upper openings 56 and 58 are positioned above and remain Within the confines of the perimeter of the lower opening 50 throughout the range of relative positions of the openings 56, 58 and 50. The upper openings 56 and 58 are thus more restrictive than the lower opening 50 in limiting the surface area of the door 14 that can be cut therethrough by a router (not shown). While openings 56 and 58 are herein shown to be rectangular in shape, it is understood that any suitable shape corresponding to the desired area to be recessed may be used. As will be discussed in greater detail later on, the first upper opening is used to form the stepped recess 31 for the bolt actuating mechanism 18 and face plate 22 (see FIGS. 5–7), and the second upper opening is used to form the recess for the bolt guide plate 26.

With either template 10 or 10', the upper channel bracket 34 is positioned over the lower channel bracket 32 with the side walls 54 and 55 respectively overlapping the side walls 38 and 39 of lower bracket 32 in a juxtaposed relation. With the particular embodiment shown, the lower bracket side walls 38 and 39 are located within the upper bracket side walls 54 and 55. However, the reverse or the relationships are possible. A plurality of headed guide pins or rivets 60 are used to maintain the channel brackets 32 and 34 in this relationship. Each guide pin 60 has two ends with one end fixed to one of the side walls 54, 55 of bracket 34, such as by being riveted in a hole 62, and the other end disposed through one of the V-shaped adjusting slots 40. In this manner, relative movement between the brackets 34 is limited to the movement of each guide pin 60 in its respective slot 40. The retaining notches 44, 46 and 48 of each adjusting slot 40 are formed at longitudinally spaced locations along the length of their corresponding side wall 38 and 39. Each of the notches 44, 46 and 48 are adapted to permit the corresponding guide pin 60 to seat therein such that when all four guide pins 60 are in the same notch 44, 46 or 48 of their corresponding slot 40, the relative position of the upper bracket 34 to the lower bracket 32 remains substantially stable while the cutting tool of a router (not shown) is used to cut a recessed area out through either opening 56 or 58.

The lower bracket 32 of template 10 is secured to the edge of door 12 by conventional means, such as temporary nails driven into the door 12 through holes 61 formed in the front end and holes 63 formed in the rear end of lower plate 36. In order to place the second upper template opening 58 in position to cut the single step recess for the bolt guide plate 26, the front end of the lower plate 36 extends beyond the side edge of door 12. Therefore, with template 10', a stop plate 64 is attached to the lower bracket 32, generally perpendicular to lower plate 36, to help maintain the position of template 10' while the single step recess for the bolt guide plate 26 is being cut. A notch 66 is formed on either side of stop plate 64 for securing the stop plate 64 in position against the front end of lower opening 50. This is accomplished by fitting the inner side edges of lower plate 36 forming opening 50 into the notches 66 (see FIGS. 2 and 4). Preferably, the side edges of opening 50 fit snugly into notches 66. The stop plate 64 may also be secured to the edge of door 14 by conventional means, such as temporary nails driven into the door 14 through holes 68 formed in stop plate 64. Other than the use of stop plate 64, templates 10 and 10' are identical. The lower plate 36 of each template 10 and 10' also includes a front and rear V-shaped notch 70 and 72 formed at either end of the lower opening 50. These notches 70 and 72 help in centering the lower opening 50 in proper position on the appropriate door edge.

Figure 3:
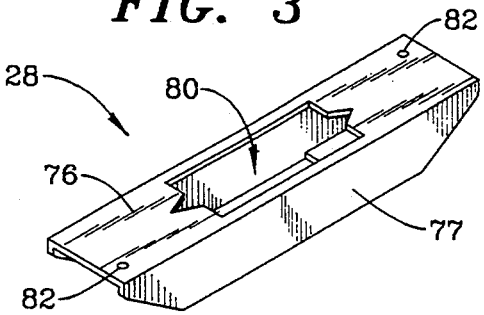
FIG. 3 is a perspective view of a fixed template for forming the recess for receiving a bolt anchor plate.
Figure 3A:
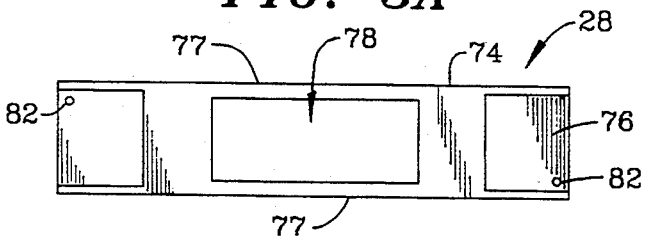
FIG. 3A is a top view of the fixed template of FIG. 3.

Referring to FIGS. 3 and 3A, the fixed template 28 includes an upper plate 74 fixed in relation to a lower plate 76 by side walls 77. An upper template opening 78 is formed through the plate 74 and a lower template opening 80 is formed through the plate 76. The lower plate 76 is secured to the door frame header 30 with temporary nails driven into header 30 through holes 82 formed in plate 76. Two V-shaped notches are formed one at either end of opening 80 in order to properly align template 28 in position for the router cutting tool (not shown) to cut the single step recess for the bolt anchor plate (not shown). The dept of any such single step recess depends upon the height of side walls 77 between plates 74 and 76. The depth of any recess formed by template 28 is thus dependant upon the height of side walls 77.

Referring to FIGS. 5–8, in order to form the stepped recess 31 for the bolt actuating mechanism 18 and face plate 20 on the side edge of either door 12 and 14, the template 10 (i.e., without stop plate 64) is secured in position as described above. Once the lower plate 36 is suitably secured, a first recess step 84 for the face plate 20 is formed in a two part process. With all the guide pins 60 seated in the forward notch 44 of their corresponding adjusting slot 40, a first shallow recess section 86 of step 84 is cut with the router cutting tool. During this and any other router cutting step, the router rests against the upper plate 52 of either template 10 and 10' and on the upper plate 74 of fixed template 28. The upper channel 34 is then shifted rearward following the contours of slots 40 until each guide pin 60 is seated in the rear most notch 46 of its corresponding adjusting slot 40. The remaining section 88 of the recess step 84 (see FIG. 6) is then cut out with the router. With the face plate step 84 having been formed, a deeper recess step 90 is then formed for receiving the bolt actuating mechanism 18. This is accomplished by repositioning each guide pin 60 into the lower most notch 48 of its corresponding adjusting slot 40 and then cutting out the area of the door that the upper opening 56 is now over. The present invention thus enables a stepped recess such as recess 31 to be cut without having to readjust the cutting tool of the router, thereby reducing the time and cost of the job.

While the recesses 84, 86, 88, and 90 can be formed according to the above method, it is understood that the sequence in which these individual recesses are formed can be readily varied in order to produce the same stepped recess 31. In addition, having herein disclosed the general principles of the present invention, it is also understood that various stepped recesses can be formed by modifying the adjusting slots 40. For example, additional recess steps can be cut by positioning additional retaining notches between the lower notch 48 and either upper notch 44 and 46 of each adjusting slot 40. In addition, two or more interconnected V-shaped adjusting slots 40 could be formed in the side walls 38 and 39 for each guide pin 60 to travel.

As can be readily seen, the surface area cut by the router is limited by the geometry of the upper openings 56 and 58. By both reducing the distance between the plates 36 and 52 and shifting the longitudinal orientation of the upper openings 56 and 58 relative to the lower opening 50, a deeper cut can be made in the door in an area that overlaps the initial area cut, thereby forming a stepped recess.

A number of stepped recesses, similar to recess 31, can thus be quickly and consistently formed with a high degree of accuracy by so adjusting the distance between the plates 36 and 52 and the relative orientation of the openings 56, 58 and 50 according to the principles of the present invention. The shape of each recess step formed can also be varied by changing the shape of the upper openings 56 and 58 used.

From the above disclosure of the general principles of the present invention and the preceding detailed description of one embodiment, those skilled in this art will readily comprehend the various modifications to which the present invention is susceptible. Therefore, the scope of the invention should be limited only by the following claims and equivalence thereof.

What is claimed is:

1. An adjustable template for use in forming a stepped recess in a door with a cutting tool of a router, said template comprising;

a first channel bracket including a bottom first plate having a lower template opening formed therethrough providing the cutting tool with access to the door, and two opposite first side walls running along its length each having two longitudinally spaced adjusting slots formed therethrough;

an inverted second channel bracket including a top second plate having an upper template opening formed therethrough providing a path to said lower template opening for the cutting tool, said upper template opening being more restrictive than said lower template opening in limiting the surface area of the door that can be cut by the router and two opposite second side walls running along its length, said second channel bracket being disposed with each of said second side walls overlapping one corresponding first side wall in a juxtaposed relation;

a plurality of guide pins, each guide pin having a first end and a second end, said first end being fixed to said second channel bracket and said second end being disposed through one of said adjusting slots;

said slots and said guide pins providing a means for adjusting the distance between said plates and the longitudinal orientation of said upper template opening relative to said lower template opening; and a means for maintaining said first plate in position over the door, thereby providing the cutting tool with access thereto.

2. The adjustable template of claim 1, each of said adjusting slots having at least two retaining notches formed at two longitudinally spaced locations along the length of its respective side wall and said at least two retaining notches being spaced at two different distances from its corresponding plate.

3. The adjustable template of claim 2, each of said retaining notches being operatively adapted to receive one of said guide pins such that with each guide pin seated in a corresponding retaining notch, the relative position of said brackets remains substantially stable while the cutting tool cuts a recessed area out of the door.

4. The adjustable template of claim 1, each of said adjusting slots having a V-shape with a first and second upper retaining notch and a lower retaining notch, said upper retaining notches being positioned the same distance from said first plate, and said lower retaining notch being closer to said first plate than said upper retaining notches.

5. The adjustable template of claim 1, said template openings being rectangular in shape.

6. The adjustable template of claim 1, said second plate having a first upper template opening longitudinally spaced from a second upper template opening, each of said template openings having a perimeter and an area therewithin, the perimeters of said upper template openings being disposed within a perimeter of said lower template opening as seen from above, and the combined areas of said upper template openings being smaller than the area of said lower template opening.

7. The adjustable template of claim 1, said lower template opening having distal ends, said means for maintaining including a stop plate secured to said first plate adjacent to one end of said lower template opening, said stop plate being oriented generally perpendicular to said first plate.

8. The adjustable template of claim 7, said lower template opening being formed by an inner edge of said first plate, said stop plate having opposite sides with a notch formed on each side, each notch being formed to receive the inner edge of said first plate therein.

9. An adjustable router template for cutting a stepped recess in a door suitable for receiving a bolt actuating mechanism of a flush bolt locking system, said template comprising:

a first channel bracket having a bottom formed by a first plate and two opposite first side walls running along its length, said first plate having a rectangular shaped lower template opening formed therethrough with a first perimeter providing a router with access to the door;

an inverted second channel bracket having a top formed by a second plate and two opposite second side walls running along its length, said second plate having a rectangular shaped upper template opening formed therethrough with a perimeter providing a path to said lower template opening for the router, said second channel bracket being disposed above said first channel bracket with said upper template opening being positioned above and within the confines of the perimeter of said lower opening throughout the cutting of the stepped recess and with each of said second side walls overlapping one corresponding first side wall in a juxtaposed relation, each of said side walls of one of said first channel bracket and said second channel bracket having two longitudinally spaced V-shaped adjusting slots formed therethrough; and a plurality of guide pins, each of said guide pins having a first end and a second end, said first end being fixed to the other of said first channel bracket and said second channel bracket and said second end being disposed through one of said adjusting slots, the distance between said plates and the longitudinal orientation of said upper template opening relative to said lower template opening being controlled by the location of each said guide pin along its respective adjusting slot.

10. The adjustable template of claim 9, each of said adjusting slots having at least three retaining notches formed at three longitudinally spaced locations along the length of its respective side wall, two of said retaining notches being spaced the same distance from their corresponding plate and one of said retaining notches being spaced at a different distance from said corresponding plate.

11. The adjustable template of claim 10, each of said retaining notches being operatively adapted to receive one of said guide pins such that with each guide pin seated in a corresponding retaining notch, the relative position of said brackets remains substantially stable while the router cuts a recessed area out of the door.

* * * * *